US007991179B2

(12) United States Patent
Drambarean et al.

(10) Patent No.: US 7,991,179 B2
(45) Date of Patent: Aug. 2, 2011

(54) HIGH FIDELITY NOISE-EXCLUDING EARPHONES WITH ERGONOMICALLY DESIGNED CONSTRUCTION

(75) Inventors: Viorel Drambarean, Skokie, IL (US); Andrew J. Haapapuro, Arlington Heights, IL (US); Mead C. Killion, Elk Grove Village, IL (US)

(73) Assignee: Etymotic Research, Inc., Elk Grove Village, IL (US)

( * ) Notice: Subject to any disclaimer, the term of this patent is extended or adjusted under 35 U.S.C. 154(b) by 1387 days.

(21) Appl. No.: 11/471,159

(22) Filed: Jun. 20, 2006

(65) Prior Publication Data

US 2006/0285715 A1 Dec. 21, 2006

Related U.S. Application Data

(60) Provisional application No. 60/692,508, filed on Jun. 20, 2005.

(51) Int. Cl.
*H04R 25/00* (2006.01)

(52) U.S. Cl. ..... 381/380; 381/328; 381/325

(58) Field of Classification Search ..... 381/380, 381/325, 328, 330, 382
See application file for complete search history.

(56) References Cited

U.S. PATENT DOCUMENTS

| | | | | |
|---|---|---|---|---|
| 4,677,679 | A | 6/1987 | Killion | |
| 4,893,344 | A * | 1/1990 | Tragardh et al. | 381/381 |
| 5,276,740 | A | 1/1994 | Inanaga et al. | |
| 5,887,070 | A | 3/1999 | Iseberg et al. | |
| 6,690,808 | B2 | 2/2004 | Urwyler | |
| 6,795,562 | B1 * | 9/2004 | Gunnersen et al. | 381/325 |
| 7,123,737 | B2 * | 10/2006 | Ham | 381/381 |
| 7,616,772 | B2 * | 11/2009 | Sabick et al. | 381/374 |
| 2003/0085070 | A1 | 5/2003 | Wickstrom | |
| 2007/0154052 | A1 * | 7/2007 | Gantz | 381/384 |

* cited by examiner

*Primary Examiner* — Curtis Kuntz
*Assistant Examiner* — Jasmine Pritchard
(74) *Attorney, Agent, or Firm* — McAndrews, Held & Malloy, Ltd.

(57) ABSTRACT

An insert high fidelity earphone is provided in which a hollow housing is connected to two tubes. A first tube is connected to the hollow housing on one side, and on the other side is inserted into an ear tip that ensures substantial sealing of the ear canal. A second tube is connected to hollow housing on one side and houses a cable that connects circuitry in the hollow housing to an audio source. The first tube comprises a damping assembly. The first tube comprises grooves on the inside wall that ensure that the damping assembly only fits in one orientation, which is the correct orientation. The damping assembly may be easily replaceable, without having to replace the entire earphone. The earphone may have a curved shape providing a comfortable and nearly invisible fit into the ear canal.

9 Claims, 10 Drawing Sheets

HIGH FIDELITY NOISE-EXCLUDING EARPHONES WITH ERGONOMICALLY DESIGNED CONSTRUCTION

RELATED APPLICATIONS

This patent application makes reference to, claims priority to and claims benefit from U.S. Provisional Patent Application Ser. No. 60/692,508, entitled "High Fidelity Noise-Excluding Earphones With Ergonomically Designed Construction," filed on Jun. 20, 2005, the complete subject matter of which is hereby incorporated herein by reference, in its entirety.

This application makes reference to:
U.S. Pat. No. 4,852,683, filed Jan. 27, 1988;
U.S. Pat. No. 5,113,967, filed May 7, 1990; and
U.S. Pat. No. 5,887,070, filed Dec. 19, 1996.

The above stated patents are hereby incorporated herein by reference in their entirety.

FEDERALLY SPONSORED RESEARCH OR DEVELOPMENT

[Not Applicable]

MICROFICHE/COPYRIGHT REFERENCE

[Not Applicable]

BACKGROUND OF THE INVENTION

With audio players of various types becoming more popular, consumer demand for earphones is higher than ever. With competitive earphone designs on the market, consumers are constantly looking for improved earphones. Some of the characteristics that consumers look for in earphones, generally, involve ease of operability and handling. For example, an earphone user prefers earphones that are easier to insert into and remove from the ear. While consumers generally prefer smaller earphones that are less visible and bulky, they also prefer earphones that do not require much force to put into the ears or remove from the ears. There can be a trade off sometimes between the size and ease of handling. Associated with that is the aesthetic aspect of the earphones offered to consumers. Some designs that can be easy to handle and operate, can sometimes involve shapes or designs that can be perceived as unattractive.

Another important characteristic that consumers look for in an earphone is the cost. While consumers desire high quality products, sometime it is not worth the price increase, and consumers end up settling for products with inferior performance in lieu of products at a higher price and more superior performance. Generally, the higher prices stem from high production prices and difficulty of assembly. Most earphones on the market nowadays either fall in the inferior performance/lower cost category or the superior performance/high cost category. Consumers generally end up choosing from one or the other, hence foregoing either performance for cost, or cost for performance.

Often, with more sophisticated earphone designs, the products can be complicated in design and hard to maintain. More specifically, certain parts within earphones that are pertinent to its functionality can certainly break down and require replacing. However, existing earphones are not very consumer-friendly in that respect, where consumers are often forced to discard earphones when certain parts stop performing their function such as, for example, dampers or filters.

This problem ties back with the cost issue, where it can become costly for those who use earphones often when they have to frequently replace their earphones.

Another, and probably one of the most important characteristics that drive a consumer's choice of an earphone is the performance. While there is a plethora of earphones on the market nowadays, the vast majority are of low- to medium-audio quality or fidelity. In addition, many of the available earphones do not have as good noise-exclusion as needed for good listening on planes, trains, and other noisy places. This can be the root of many problems with earphones. Having poor noise-exclusion generally means that surrounding noise is often loud enough to suppress whatever the earphone user may be trying to listen to. As a result, the user will often turn the volume up, which creates numerous problems. First, the loud sounds can be very uncomfortable and bothersome for the consumers, and can be unhealthy for the hearing, and can cause hearing loss. Additionally, when a consumer turns the volume up, the quality of the audio she may be trying to listen to becomes very poor, especially the bass associated with the audio, which generally is not boosted correctly when the volume is increased to overcome the surrounding noise. Some products add a bass boost to try and cover up the surrounding noise, which generally has a low frequency emphasis, but that amount of bass boost is completely incorrect when excessive noise is not present because it alters the music or audio as intended by the artist or band performing the music, etc.

Further limitations and disadvantages of conventional and traditional approaches will become apparent to one of skill in the art, through comparison of such systems with some aspects of the present invention as set forth in the remainder of the present application with reference to the drawings.

BRIEF SUMMARY OF THE INVENTION

A system and/or method is provided for earphone design, substantially as shown in and/or described in connection with at least one of the figures, as set forth more completely in the claims.

These and other features and advantages of the present invention may be appreciated from a review of the following detailed description of the present invention, along with the accompanying figures in which like reference numerals refer to like parts throughout.

DETAILED DESCRIPTION OF THE INVENTION

This invention relates to earphones and especially to a high fidelity noise-excluding earphones with ergonomically designed construction.

Figure 1:
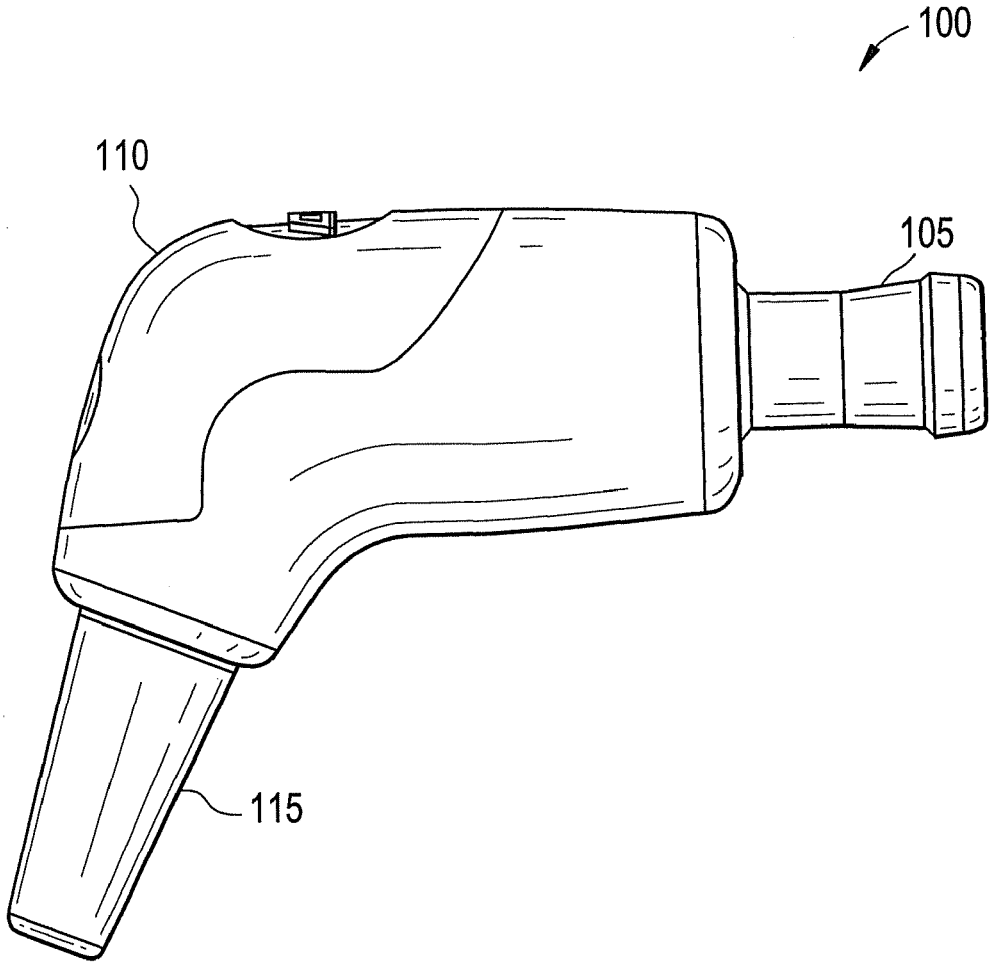
FIG. 1 illustrates an exemplary earphone, in accordance with an embodiment of the present invention.

FIG. 1 illustrates an exemplary earphone 100, in accordance with an embodiment of the present invention. The earphone 100 may comprise a sound tube 105, a cap 110, and a grommet 115. The sound tube 105 may be inserted into different shaped ear tips that may be chosen by a user based on a desired comfort level. The cap 110 may house the circuitry and/or any hardware utilized in the earphone 100. The grommet 115 may house a wire that may connect any circuitry and/or hardware housed within the cap 110 to a device (not shown) that may play the audio to which a user may be listening. The curved shape of the earphone 100 may provide ease of insertion into the ear of the user when an ear tip is attached to the sound tube 105. The design and shape of the earphone 100 may provide maximum comfort to the user, where the earphone 100 may be inserted into the ear canal without causing discomfort to the user. The shape of the earphone may ensure that the earphone may be fully and comfortable inserted in the user's ear canal without pushing against the user's tragus. The cap 110 of the earphone 100 may fit comfortably and with little visibility in the user's ear, all the while, the shape may provide for an easier grip for the user to be able to easily remove the earphone 100 from the ear. The grommet 115 may be shaped such that it tapers in a natural curve, hence ensuring that the wires connecting the earphone 100 to the audio device may not protrude outwardly in an awkward placement. Additionally, the shape of the cap 110 may allow for an increased area for easier labeling of the earphone 100.

Figure 2:
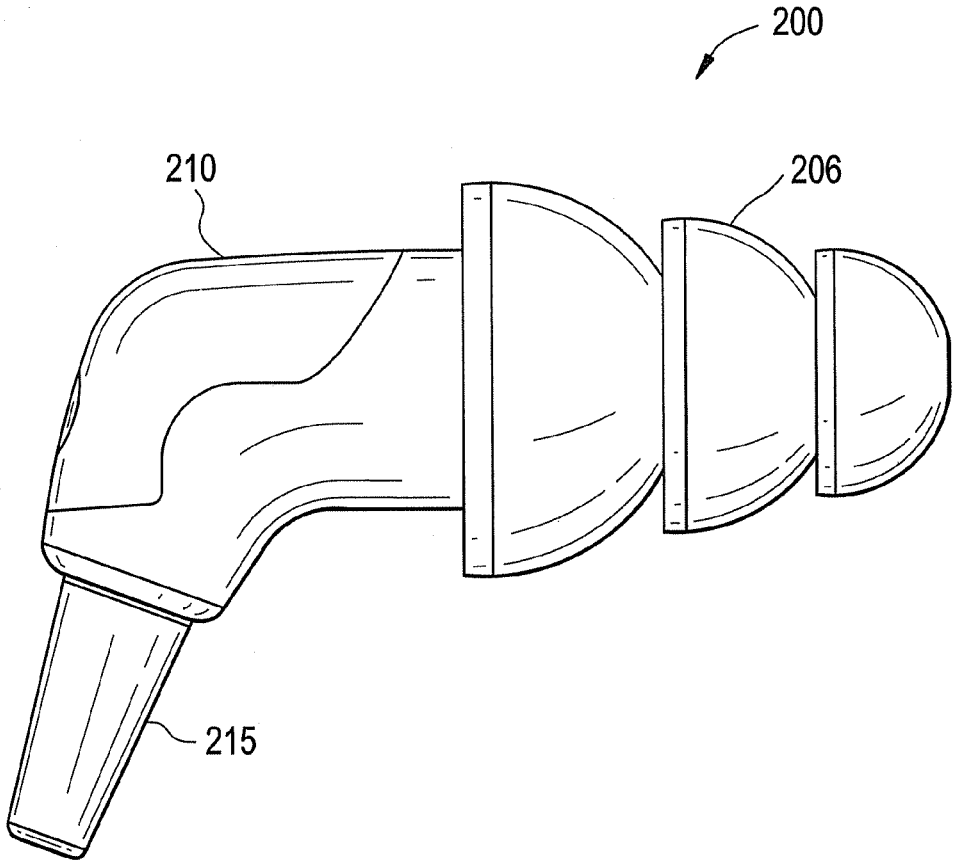
FIG. 2 illustrates another exemplary earphone, in accordance with an embodiment of the present invention.

FIG. 2 illustrates another exemplary earphone 200, in accordance with an embodiment of the present invention. The earphone 200 may comprise a sound tube (not shown) such as, for example, the sound tube 105 of FIG. 1, where the sound tube may be inserted into an ear tip 206. The earphone 200 may also comprise a cap 210 and a grommet 215. The cap 210 may house the circuitry and/or any hardware utilized in the earphone 200. The grommet 215 may house a wire that may connect any circuitry and/or hardware housed within the cap 210 to a device (not shown) that may play the audio to which a user may be listening. The ear tip 206 may comprise a triple-flange ear-tip, where each of the three flanges may be generally round. The use of the three ear-tip flanges may increase the percentage of persons who can obtain a good comfortable seal in the ear canal. The ear-tip flanges may be in a decreasing size, whereas the smallest flange may be closest to the tip of the earphone 200, and the largest flange may be farthest away from the tip of the earphone 200. Consequentially, if the smallest flange does not seal the ear canal well, the slightly larger flange may do so, and if the flange also does not completely seal the ear canal, the largest flange may do so, thus ensuring a comfortable and good seal of the ear canal for a larger number of users than if one flange were used. In an embodiment of the present invention, the ear tip 206 may be similar to the ear tip available in high-fidelity earplugs such as, for example, the high-fidelity earplugs disclosed in U.S. Pat. No. 4,852,683, filed Jan. 27, 1988, and U.S. Pat. No. 5,113,967, filed May 7, 1990, and high-fidelity insert earphones such as, for example, the high-fidelity insert earphones disclosed in U.S. Pat. No. 5,887,070, filed Dec. 19, 1996. Accordingly, U.S. Pat. No. 4,852,683, filed Jan. 27, 1988, U.S. Pat. No. 5,113,967, filed May 7, 1990, and U.S. Pat. No. 5,887,070, filed Dec. 19, 1996, are hereby incorporated herein by reference in their entirety.

Ensuring a good seal to the ear canal for a hearing aid may provide a good performance, because, for example, it may prevent unwanted audio feedback of sounds or outside noise seeping in, which may interfere with the sounds coming through the earphone 200 from an audio source to which it may be connected.

Figure 3A:
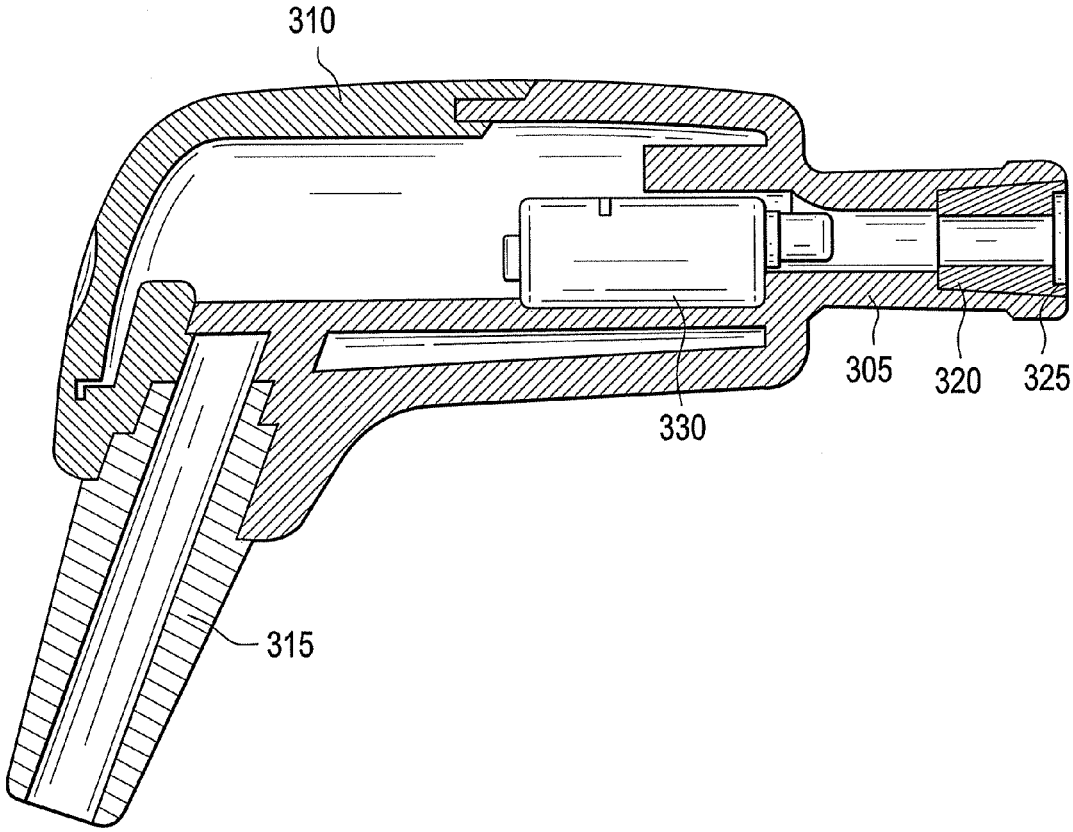
FIG. 3*a* illustrates a cross sectional view of an exemplary earphone 300, in accordance with an embodiment of the present invention.

FIG. 3*a* illustrates a cross sectional view of an exemplary earphone 300, in accordance with an embodiment of the present invention. The earphone 300 may comprise a sound tube 305, a cap 310, and a grommet 315. The sound tube 305 may be inserted into different shaped ear tips that may be chosen by a user based on a desired comfort level. The ear tip may be, for example, an ear tip 206 of FIG. 2. The cap 310 may house the circuitry and/or any hardware utilized in the earphone 300. The grommet 315 may house a wire that may connect any circuitry and/or hardware housed within the cap 310 to a device (not shown) that may play the audio to which a user may be listening. The cap 310 may house, for example, a circuitry 330, which may comprise, for example, a transducer receiver. The sound tube 305 may house, for example, a damper plug 320 and a damper filter 325.

The circuitry and hardware of the earphone of the present invention may be assembled and encased with the sound tube 305, cap 310, and grommet 315 of the earphone 300. Ease of assembly of the earphone 300 may provide for easier assembly and lower costs of production. In addition, the shape of the damper plug 320 and the damper filter 325 may make it easier to assemble the pieces together in only one way, which is the correct order of assembly. As a result minimizing errors in assembly.

In an embodiment of the present invention, the damper filter 325 may be easily replaceable, where the whole earphone 300 may not have to be taken apart to replace the filter 325. The damper filter 325 may be easily removed by the user and replaced with a new one without having to dispose of the whole earphone unit 300, hence saving the user the cost of buying a whole new earphone unit 300.

Figure 3B:
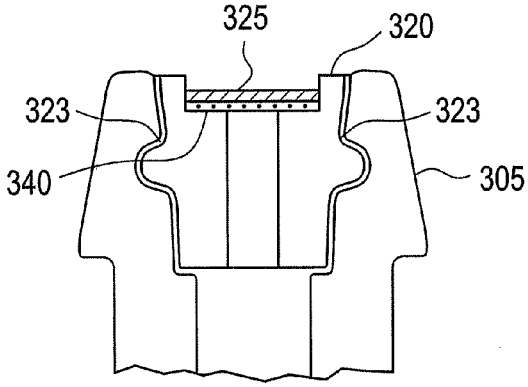
FIG. 3*b* illustrates a diagram of an exemplary damper assembly, in accordance with an embodiment of the present invention.

FIG. 3*b* illustrates a diagram of an exemplary damper assembly, in accordance with an embodiment of the present invention. The damper assembly may comprise a damper plug 320, which may have a small protruding ring 323 corresponding to grooves in the sound tube 305, such that the damper plug 320 may only fit within the sound tube 305 in one orientation, hence eliminating the possibility of inserting the damper plug 320 in an incorrect orientation. Additionally, the small protruding rings 323 may ensure securing the damper plug 320 firmly in place within the sound tube 305. The damper filter 325 may be affixed to the damper plug 320 using a layer of adhesive substance 340. When the performance of the damper plug 320 deteriorates, the damper plug 320 may be easily replaced by removing and replacing with a new damper plug 320. Replacing the damper plug 320 may be far more financially sound and cost effective than replacing the entire earphone.

Figure 3C:
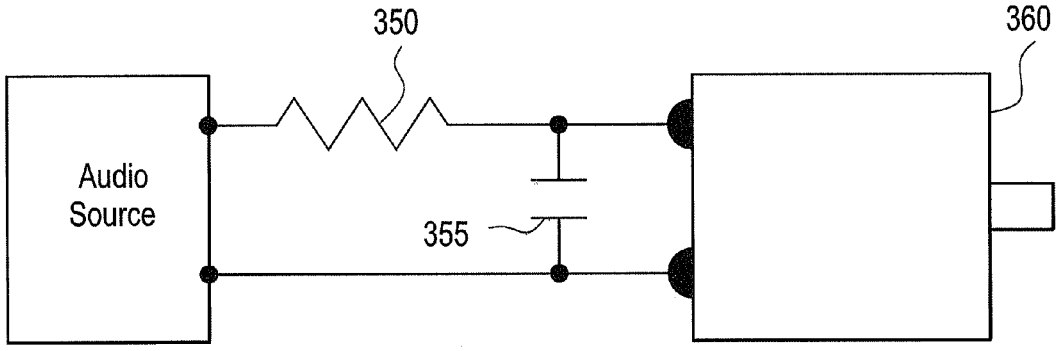
FIG. 3*c* illustrates an exemplary circuitry 330, in accordance with an embodiment of the present invention.

FIG. 3*c* illustrates an exemplary circuitry 330, in accordance with an embodiment of the present invention. The circuitry 330 may comprise a transducer receiver 360 connected in parallel with a capacitor 355, and in series with a resistor 350. The values of the circuitry are explored hereinafter.

Figure 4:
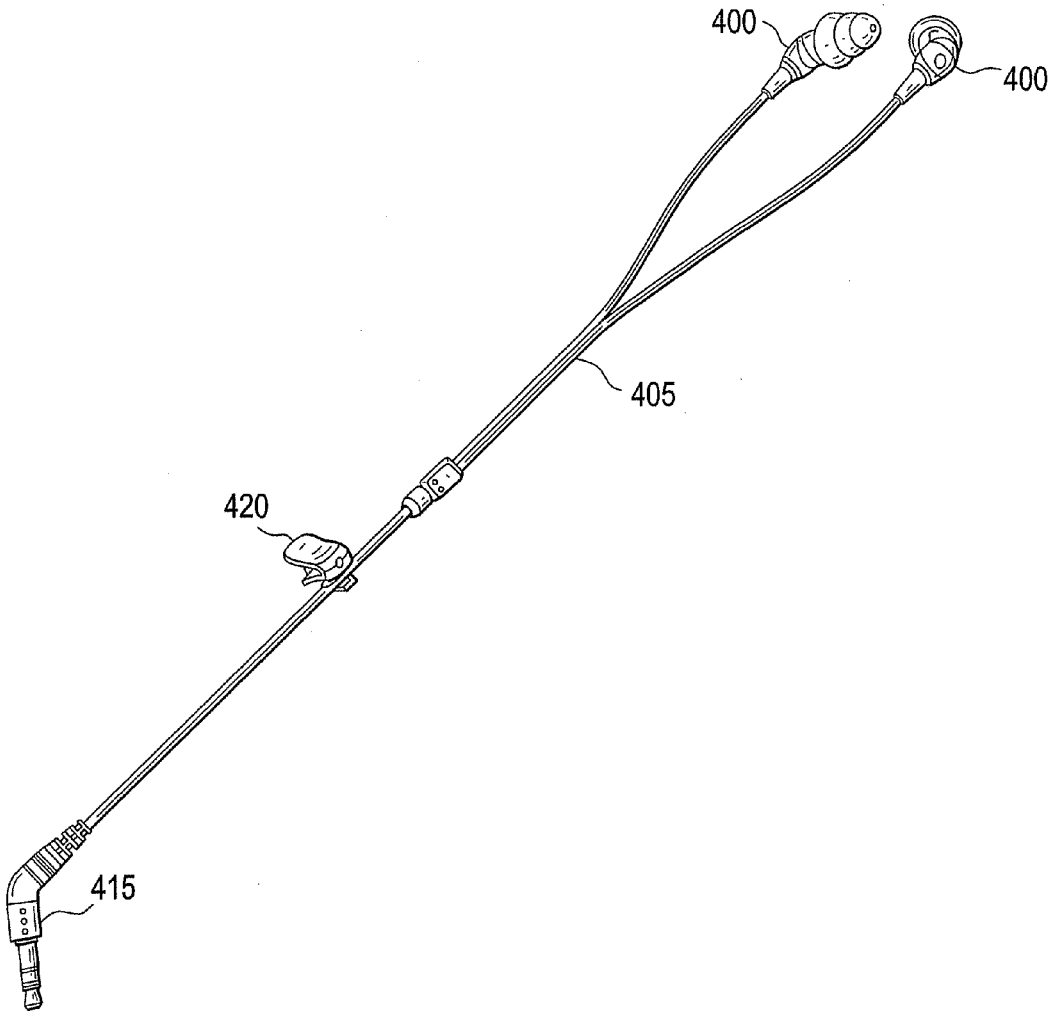
FIG. 4 illustrates an exemplary diagram of an earphone set, in accordance with an embodiment of the present invention.

FIG. 4 illustrates an exemplary diagram of an earphone set, in accordance with an embodiment of the present invention. The earphone set may comprise earphones 400, each of which may be, for example, earphone 300 of FIG. 3*a*. The earphones 400 may be connected via a wire 405 to a plug 415. The plug 415 may be used to connect the earphones 400 to any device with an audio output port. The earphone set may also comprise a shirt clip 420, which may be utilized to fasten the wires to a user's clothing. The clip 420 may be stationary or adjustable.

Figure 5:
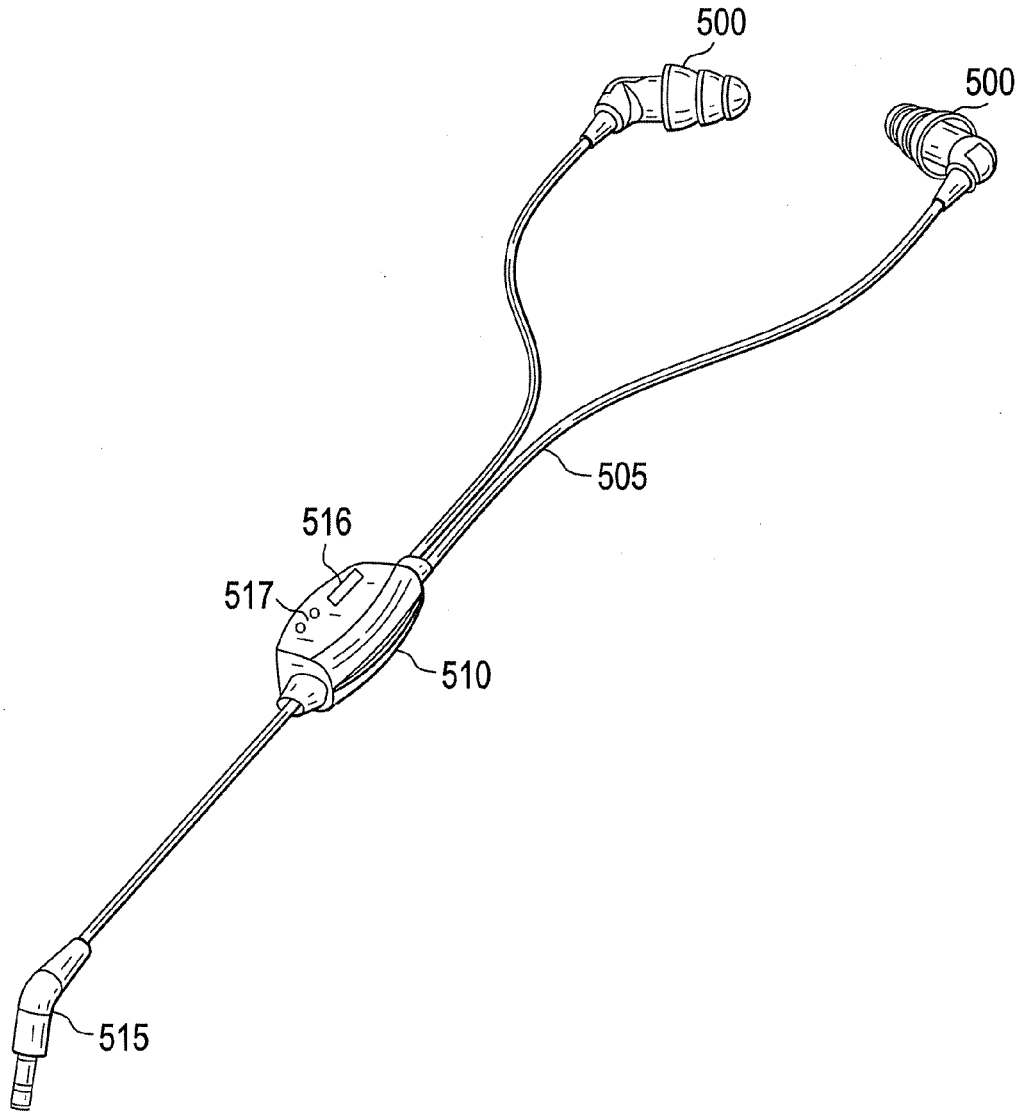
FIG. 5 illustrates another exemplary diagram of an earphone set, in accordance with an embodiment of the present invention.

FIG. 5 illustrates another exemplary diagram of an earphone set, in accordance with an embodiment of the present invention. The earphone set may comprise earphones 500, which may be, for example, earphone 300 of FIG. 3*a*. The earphones 500 may be connected via a wire 505 to a plug 515. The plug 515 may be used to connect the earphones 500 to any device with an audio output port. The earphone set may also comprise a variable output controller 510, which may be utilized to modify the total quality of the audio signal as desired by the user.

One embodiment of the variable output controller 510 may function as a "bass boost/sensitivity" control module. The switch 516 may be used to select between a low sensitivity "flat response" mode and a high sensitivity "bass boost" mode. In this embodiment the volume control 517 may change the overall loudness of the earphone. When in an environment without too much background noise, bass boost may not be needed. When not needed, the switch on the bass boost unit 510 may be turned to the "off" position. In other environments where there may be a lot of constant background noise that may harder to minimize such as, for example, in an airplane, the bass boost may be needed and the switch on the bass boost unit 510 may be turned to the "on" position.

Figure 6:
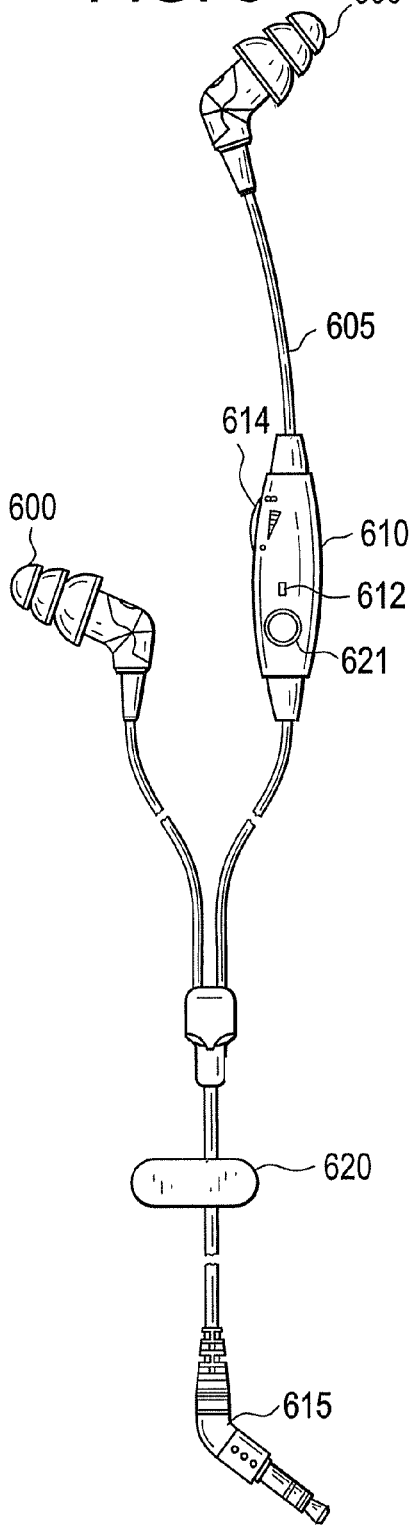
FIG. 6 illustrates another exemplary diagram of an earphone set, in accordance with an embodiment of the present invention

FIG. 6 illustrates another exemplary diagram of an earphone set, in accordance with an embodiment of the present invention. The earphone set may comprise earphones 600, which may be, for example, earphone 300 of FIG. 3*a*. The earphones 600 may be connected via a wire 605 to a plug 615. The plug 615 may be used to connect the earphones 600 to any device with an audio output port. The earphone set may also comprise a shirt clip 620, which may be utilized to fasten the wires to a user's clothing. The clip 620 may be stationary or adjustable. The earphone set may also comprise an in-line microphone unit 610. The in-line microphone unit 610 may, for example, comprise a microphone slot 612 and controls 614 that enable the user to control the volume of the signal received by earphone unit 600. In addition, an "end-send" switch 621 may be included in microphone unit 610 to facilitate use with stereo cell phones and the like.

Figure 7:
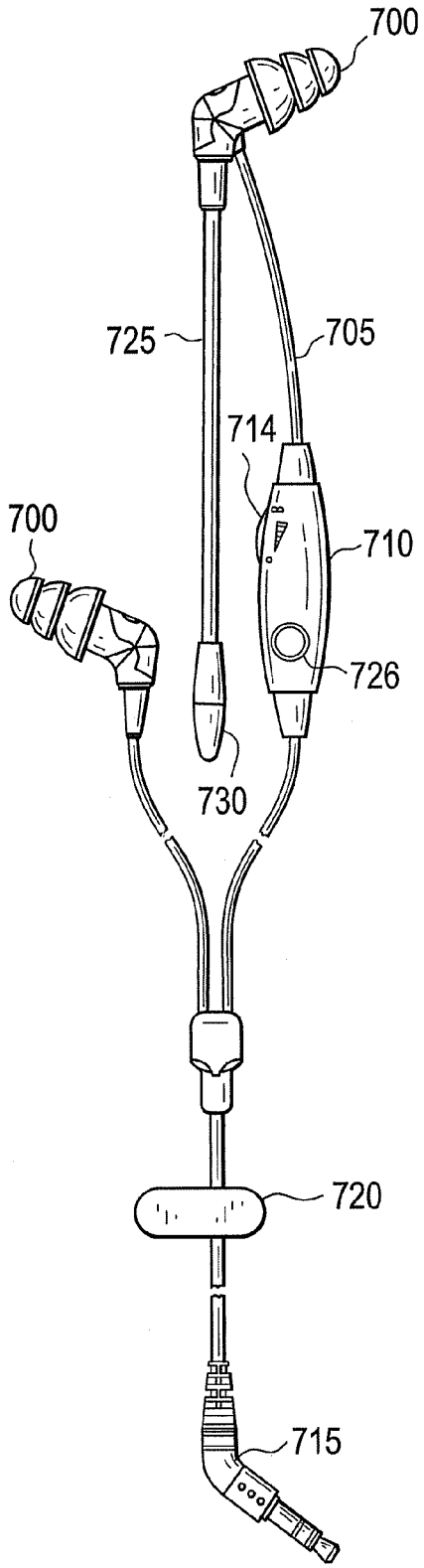
FIG. 7 illustrates another exemplary diagram of an earphone set, in accordance with an embodiment of the present invention.

FIG. 7 illustrates another exemplary diagram of an earphone set, in accordance with an embodiment of the present invention. The earphone set may comprise earphones 700, which may be, for example, earphone 300 of FIG. 3*a*. The earphones 700 may be connected via a wire 705 to a plug 715. The plug 715 may be used to connect the earphones 700 to any device with an audio output port. The earphone set may also comprise a shirt clip 720, which may be utilized to fasten the wires to a user's clothing. The clip 720 may be stationary or adjustable. The earphone set may also comprise an in-line microphone unit 710 and a directional microphone 730 at the end of a gooseneck 725. The in-line microphone unit 710 may, for example, comprise controls 714 that enable the user to control the volume of the signal received by the microphone 730. In addition, an "end-send" switch 726 can be included in microphone unit 700 to facilitate use with stereo cell phones and the like.

In an embodiment of the present invention, the design of the earphones in conjunction with the ear tip used for insertion into a user's ear may ensure a comfortable and complete seal to the ear canal. As a result, surrounding noises may be eliminated and the level of noise may be greatly reduced. In some noise situations such as, for example, an airplane environment where the noise level may be typically around 80 dBA, an embodiment of the present invention, may reduce the noise level to 40-45 dBA, which may be equivalent to the noise level in a typical quiet living room environment.

In an embodiment of the present invention, the earphones may provide sounds without exaggerated bass and without high frequency sounds or feedback noise, and without muffled high frequency noises, hence providing sounds close to a live performance, for example, in a situation where a user may be listening to a performing artist.

In an embodiment of the present invention, the earphones may provide a 25-band accuracy score of 94% or higher, which is at least 2-4% higher than any previous accuracy scores known. In the past capacitors have been used in parallel with the resistor in series with the receiver to increase the high frequency response. To achieve the accuracy score of 94%, a resistor (82 Ohms) is placed in series with the receiver, and the capacitor (1 uF) placed in parallel with the receiver. As a result, the frequency response may be decreased in the frequency region above 10 kHz and increased in the 8 kHz region. This method may run contrary to the previous teachings of system designers, but may effectively increase the accuracy score. Accuracy score may be calculated based on the deviation from the frequency response. In comparison, some of the marketed earphones that are widely used have accuracy scores such as: 55%, 68%, 64%, 50%, 80%, and 41%.

In an embodiment of the present invention, the earphones may provide noise isolation, which may effectively be used in reducing background noise. When background is present it may be just as important to isolate noise, as it is to have response frequency. The earphones of the present invention may isolate background noise for removal of noise to provide maximum response accuracy. The earphones may provide about 40-45 dB noise reduction.

Figure 8:
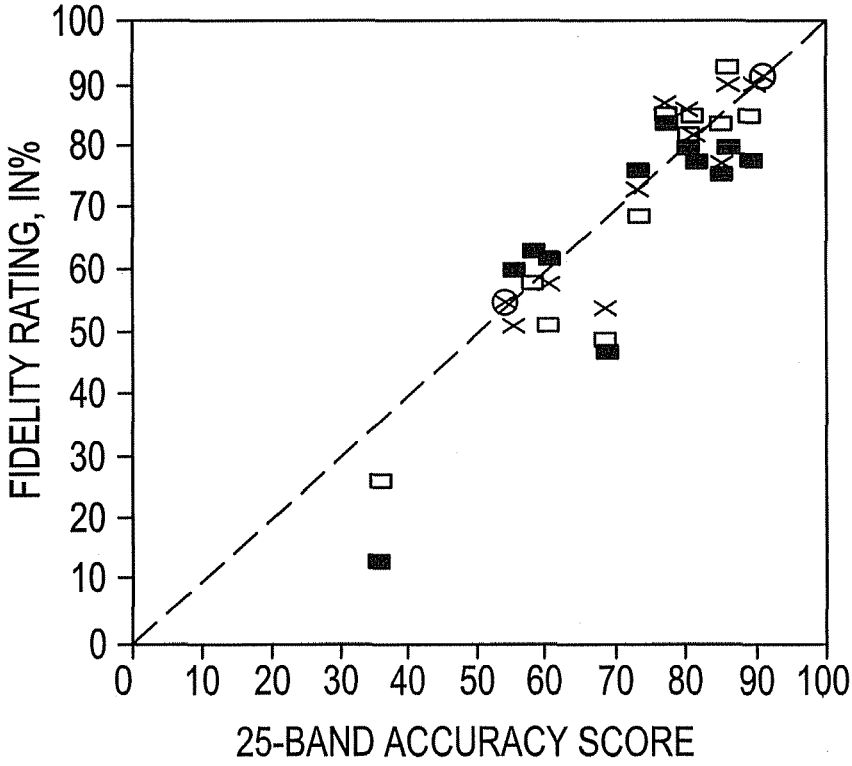
FIG. 8 illustrates an exemplary plot of fidelity rating versus accuracy score.

FIG. 8 illustrates an exemplary plot of fidelity rating versus accuracy scores. As this illustrates, for at least 25 years, it has been known that fidelity ratings can be accurately predicted from the accuracy of the frequency response. Published by Mead C. Killion, Ph.D. Thesis Northwestern University, 1979 "Design and Evaluation of High Fidelity Hearing Aids." This was reconfirmed recently in a paper appearing in the January 2004 issue of the journal Hearing Review (Myths that Discourage Improvements in Hearing Aid Design).

Figure 9A:
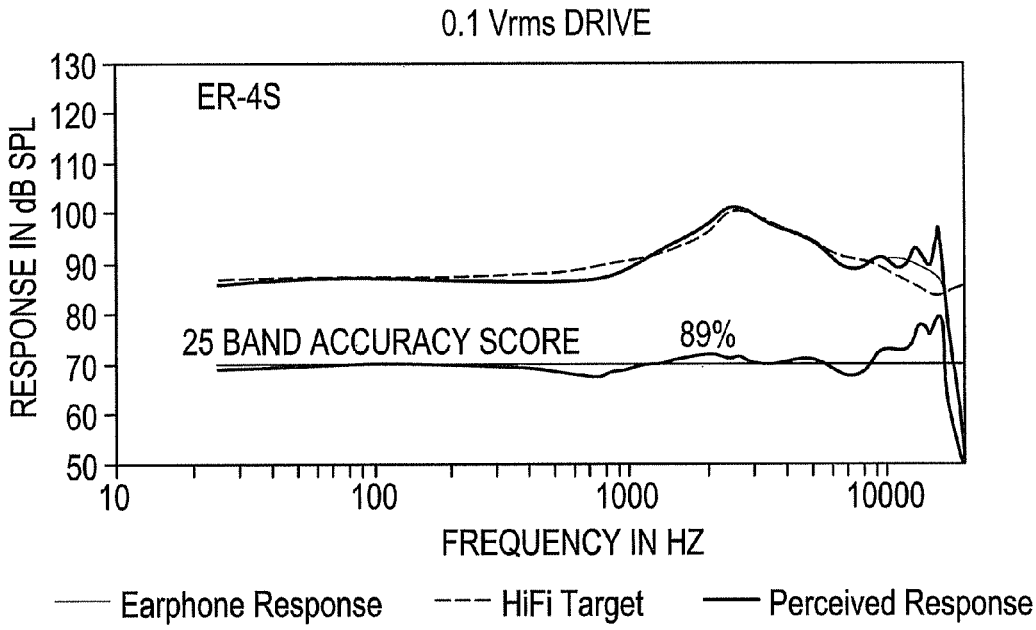
FIG. 9A PRIOR ART
FIG. 9*a* illustrates a plot of a frequency response of a previous earphone.
Figure 9B:
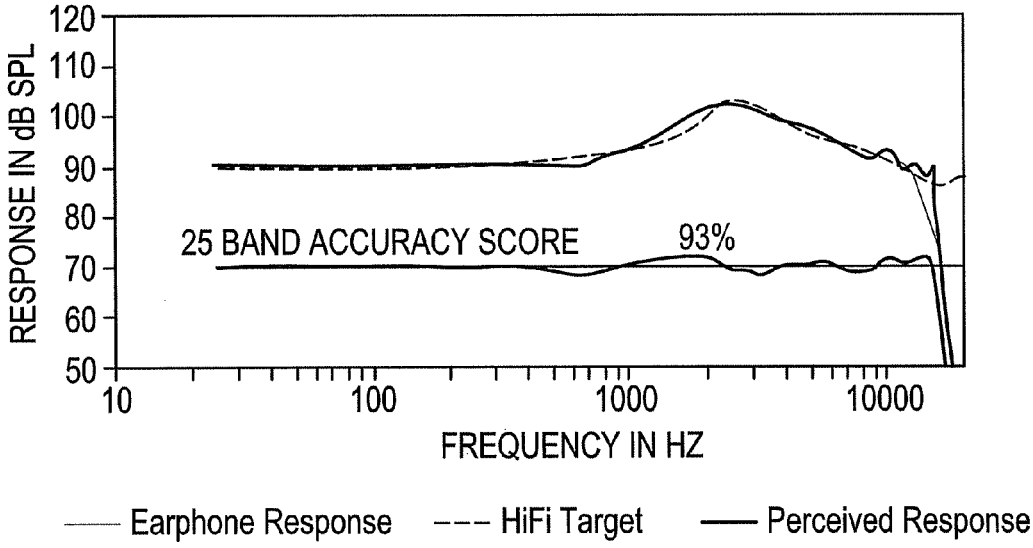
FIG. 9*b* illustrates the frequency response, in accordance with an embodiment of the present invention.

FIG. 9*a* illustrates a plot of a frequency response of an earphone. This plot illustrates the high accuracy scores of previous earphones as shown by U.S. Pat. No. 5,887,070, filed Dec. 19, 1996, which is hereby incorporated herein by reference in its entirety. FIG. 9*b* illustrates the frequency response, in accordance with an embodiment of the present invention. The frequency response of FIG. 9*b* corresponds to the circuitry with the capacitor placed in parallel with the receiver as shown in FIG. 3*c*.

In an embodiment of the present invention, the seal the earphones may provide to the ear canal may be stable, and may not be affected by any shifting and movement by the user. The ear tip may be, for example, a three-flange ear tip such as the ear tip 206 of FIG. 2. The ear tip may alternatively be a foam ear tip, which may be compressed, pushed in the ear, and allowed to expand to the shape of the ear, hence providing a tight seal to the ear canal.

Earphones of the present invention may be used with any device that plays audio such as, for example, a MP3 players, laptops, personal computers, CD players, airplane audio panels, etc. The earphones' performance may be similar regardless of the device and the type of music played.

While the present invention has been described with reference to certain embodiments, it will be understood by those skilled in the art that various changes may be made and equivalents may be substituted without departing from the scope of the present invention. In addition, many modifications may be made to adapt a particular situation or material to the teachings of the present invention without departing from its scope. Therefore, it is intended that the present invention not be limited to the particular embodiment disclosed, but that the present invention will include all embodiments falling within the scope of the appended claims.

What is claimed is:

1. An insert earphone assembly comprising:

a hollow curved housing cap, wherein said hollow curved housing cap houses earphone circuitry;

a sound tube connected to said hollow curved housing cap, wherein said sound tube is inserted into an ear tip, wherein said sound tube houses a removable damper assembly comprising a damper plug affixed with a damper filter and comprising a protruding ring, and wherein an inside of said sound tube comprises grooves for mating with said protruding ring of said damper plug to ensure correct insertion of said removable damper assembly; and a grommet connected to said hollow curved housing cap, wherein said grommet houses a cable that connects said earphone circuitry to an audio source.

2. The insert earphone assembly of claim 1 further comprising a plug connected to said cable, wherein said plug is inserted into said audio source.

3. The insert earphone assembly of claim 1 further comprising a clip mounted on said cable, wherein said clip fastens said cable to an object.

4. The insert earphone assembly of claim 1 wherein said ear tip substantially sealing an ear canal, when inserted into said ear canal.

5. The insert earphone assembly of claim 1 further comprising a circuitry mounted on said cable, wherein said circuitry comprises controls for adjusting at least one of: volume and bass of an audio signal from said audio source.

6. A high fidelity earphone comprising:

a hollow curved housing cap, wherein said hollow curved housing cap houses earphone circuitry;

a sound tube connected to said hollow curved housing cap, wherein said sound tube is inserted into an ear tip, wherein said sound tube houses a removable damper assembly comprising a damper plug affixed with a damper filter and comprising a protruding ring, and wherein an inside of said sound tube comprises grooves for mating with said protruding ring of said damper plug to ensure correct insertion of said removable damper assembly; and a grommet connected to said hollow curved housing cap, wherein said grommet houses a cable that connects said earphone circuitry to an audio source.

7. The high fidelity earphone of claim 6 wherein said ear tip substantially sealing an ear canal, when inserted into said ear canal.

8. The high fidelity earphone of claim 6 wherein said ear tip comprises a three-flange ear tip.

9. The high fidelity earphone of claim 6 wherein said ear tip comprises a foam ear tip.

* * * * *